US009585528B2

(12) United States Patent
Khamphilapanyo et al.

(10) Patent No.: US 9,585,528 B2
(45) Date of Patent: Mar. 7, 2017

(54) ANTI-LIGATURE DISPENSER

(71) Applicant: GOJO Industries, Inc., Akron, OH (US)

(72) Inventors: Touby Khamphilapanyo, Cuyahoga Falls, OH (US); Aaron M. Kurchev, Atwater, OH (US); Michael Prediger, Rittman, OH (US)

(73) Assignee: GOJO INDUSTRIES, INC., Akron, OH (US)

( * ) Notice: Subject to any disclaimer, the term of this patent is extended or adjusted under 35 U.S.C. 154(b) by 0 days.

(21) Appl. No.: 14/967,711

(22) Filed: Dec. 14, 2015

(65) Prior Publication Data

US 2016/0174778 A1 Jun. 23, 2016

Related U.S. Application Data

(60) Provisional application No. 62/094,275, filed on Dec. 19, 2014.

(51) Int. Cl.

| | |
|---|---|
| ***A47B 95/00*** | (2006.01) |
| ***A47K 10/32*** | (2006.01) |
| ***B26F 3/02*** | (2006.01) |
| ***A47K 5/12*** | (2006.01) |
| ***B26D 1/02*** | (2006.01) |

(52) U.S. Cl.

CPC ..... *A47K 10/32* (2013.01); *A47K 5/12* (2013.01); *B26D 1/025* (2013.01); *B26F 3/02* (2013.01); *A47K 2010/3233* (2013.01); *A47K 2201/02* (2013.01)

(58) Field of Classification Search

CPC ..... A47B 95/008; B61D 37/00; A47K 10/24; A47K 10/26; A47K 10/28; A47K 10/36; A47K 2010/3233

USPC ..... 222/180, 181.3; 221/282, 283, 312 R; 312/245, 34.8, 34.1

See application file for complete search history.

(56) References Cited

U.S. PATENT DOCUMENTS 1,102,869 A * 7/1914 Carmer ..... G09F 3/16 220/476
1,424,017 A * 7/1922 Hellstrom ..... A47F 13/085 221/45
1,930,180 A * 10/1933 Naylor ..... A47B 77/06 211/127.1
3,192,008 A * 6/1965 Dwyer ..... A47K 10/32 239/274
3,215,481 A * 11/1965 Kobi ..... A47K 10/28 312/34.15

(Continued)

FOREIGN PATENT DOCUMENTS

WO 2011004199 * 1/2011

OTHER PUBLICATIONS

Department of Veterans Affairs; Office of Construction & Facilities Management design guide; Dec. 2010.

*Primary Examiner* — Janet M Wilkens
(74) *Attorney, Agent, or Firm* — Renner Kenner Grieve Bobak Taylor & Weber

(57) ABSTRACT

A dispenser includes a backplate mountable to a surface. The backplate has a cover associated with it. An anti-ligature fixture is associated with either the backplate or the cover. The anti-ligature fixture is positioned to cut any ligature positioned between the dispenser and the surface as an anchor point.

21 Claims, 5 Drawing Sheets

(56) References Cited

U.S. PATENT DOCUMENTS 3,722,767 A * 3/1973 Struble ..... B65D 83/0882 225/49
3,858,951 A * 1/1975 Rasmussen ..... A47K 10/28 312/34.12
4,448,462 A * 5/1984 Smith ..... A47K 10/28 242/535.3
4,613,996 A * 9/1986 Chase ..... A47D 5/003 5/135
7,611,030 B2 * 11/2009 Reynolds ..... A47K 5/1217 222/1
7,631,655 B1 12/2009 Kopp ..... 137/15.18
7,774,902 B2 8/2010 Whyzel ..... 16/436
8,534,723 B2 9/2013 Berger ..... 292/347
8,555,553 B2 10/2013 Block et al. ..... 49/501
8,584,494 B2 11/2013 Salvatore et al. ..... 70/210
8,613,162 B2 12/2013 Keller ..... 49/501
8,646,151 B2 2/2014 Kopp et al. ..... 16/110.1
8,646,206 B2 2/2014 Gilchrist ..... 49/13
8,740,266 B2 6/2014 Keller ..... 292/347
8,803,689 B2 8/2014 Berger ..... 340/573.1
2007/0257058 A1 * 11/2007 Ophardt ..... A47K 5/12 222/129
2010/0089782 A1 * 4/2010 Lo Duca ..... B65D 83/0841 206/389
2011/0024585 A1 * 2/2011 Brinkdopke ..... F16B 45/02 248/205.4
2011/0315245 A1 12/2011 Neagoe ..... 137/560
2012/0097701 A1 * 4/2012 Benedetti ..... A47K 10/32 221/283
2013/0112714 A1 * 5/2013 Ho ..... A47K 5/1207 222/181.3
2015/0144660 A1 * 5/2015 Wertheim ..... B05B 11/0037 222/181.3
2016/0090765 A1 * 3/2016 Abell ..... E05D 7/1011 49/506
2016/0135652 A1 * 5/2016 Cittadino ..... A47K 10/38 312/34.8

* cited by examiner

ANTI-LIGATURE DISPENSER

CROSS-REFERENCE TO RELATED APPLICATIONS

This application claims priority of U.S. Provisional Application Ser. No. 62/094,275 filed Dec. 19, 2014, which is incorporated herein by reference.

TECHNICAL FIELD

The present invention is generally directed to dispensers which dispense a consumable product, such as soap, lotion, paper towels, or the like. Specifically, the present invention is directed to a dispenser with a safety feature. In particular, the present invention is directed to surface mounted dispensers with an anti-ligature feature that thwarts suicide attempts.

BACKGROUND ART

In environments with high suicide rates, such as medical facilities, prisons, detention centers, and mental health facilities, various structures within a room of the facility may be used as an anchor point in suicide attempts. Anchor points are used to support ligatures, such as rope, sheets, fabric, string and the like, wherein the ligature is used by an individual to commit suicide by strangulation. Skilled artisans will appreciate that full suspension from an anchor point is not required. Death by hanging or strangulation can occur while a person is partially suspended or in a kneeling, lying down, or seated position.

To prevent such occurrences from happening, rooms and fixtures may be designed to remove or at least minimize fixtures with such anchor points. Anchor points may be doors, grab bars, handles, door knobs and the like. Exemplary design guidelines are set out in such documents as the Department of Veteran's Affairs—Office of Construction and Facilities Management Design Guide, December 2010. Fixtures, and especially bathroom fixtures, are of concern because they are usually in areas where most people are given privacy.

However, unlike other bathroom or room fixtures, no specific guidelines for surface mounted dispensers have been provided. In considering other room fixtures, it is generally known to provide dispensers with smooth downwardly sloping surfaces. However, in some instances the dispenser is mounted to a surface and a gap occurs between the surface and the dispenser. This gap allows for the insertion of the ligature such that the dispenser can be used as an anchor point. Some dispensers specifically include features that attempt to minimize the gap or block entry of ligature material from entering the gap. Although presumably effective, it is believed that known mounted dispensers still provide a gap between the mounting surface and the dispenser's housing. Indeed, it is believed that over time a gap may naturally form or that persistent repeated movement may cause a gap to form. Therefore, there is a need to prevent the use of surface mounted objects, such as dispensers, from use as an anchor point.

SUMMARY OF THE INVENTION

In light of the foregoing, it is a first aspect of the present invention to provide an anti-ligature dispenser It is another aspect of the present invention to provide a dispenser comprising a backplate mountable to a surface, a cover associated with the backplate, and an anti-ligature fixture associated with either the backplate or the cover, wherein the anti-ligature fixture is positioned to cut any ligature positioned between the dispenser and the surface as an anchor point.

Still another aspect of the present invention is to provide an anti-ligature dispenser mountable to a surface comprising a backplate adapted to be mounted to the surface, a housing cover having an underside, the housing cover hingedly connected to the backplate, the housing cover having a cover edge substantially surrounding the backplate so as to abut the surface as closely as possible, and at least one fixture extending from either the backplate or the housing cover underside so that any ligature disposed between the surface and the housing cover is engaged and rendered ineffective by the catch.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
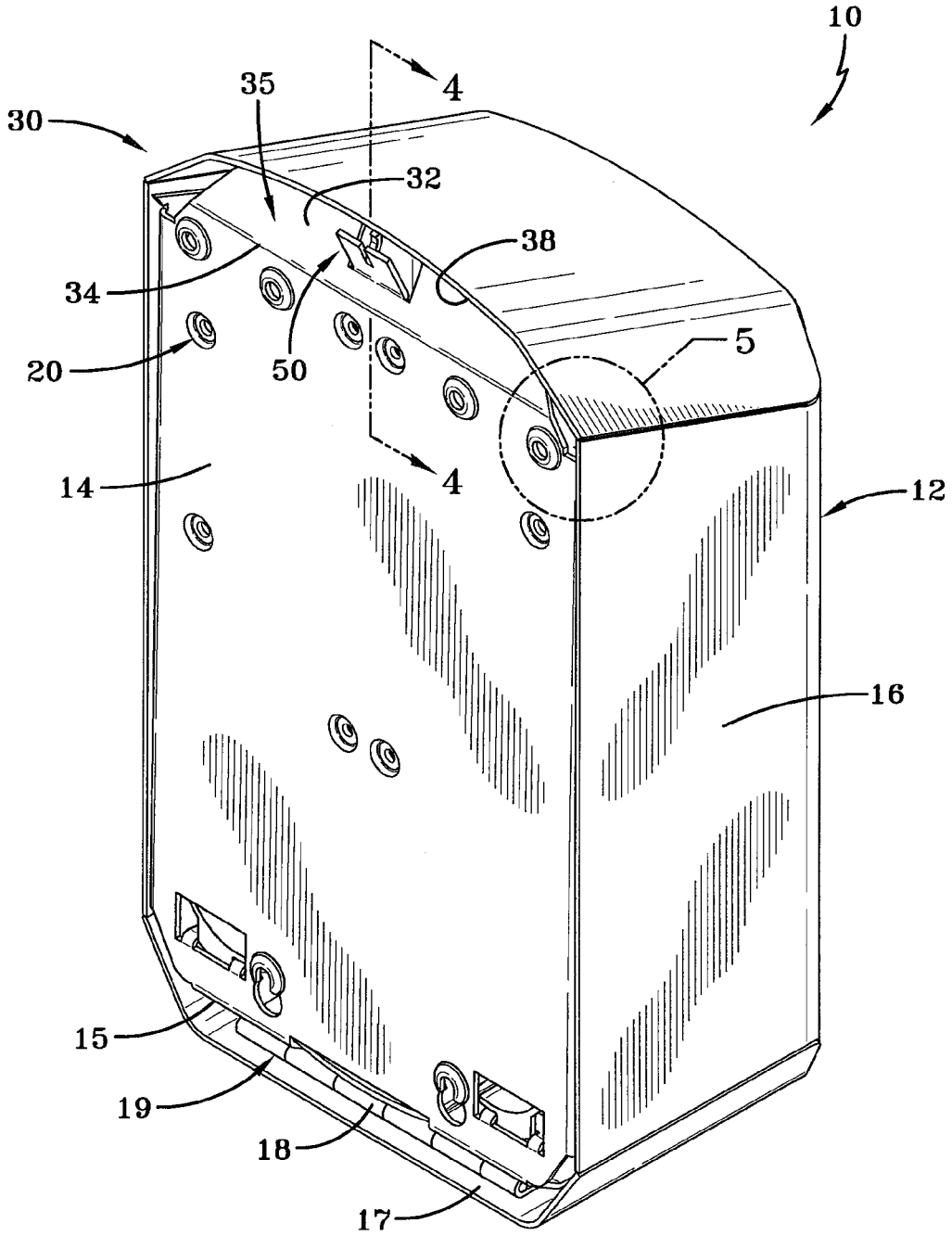
FIG. 1 is a rear perspective view of an anti-ligature dispenser according to the concepts of the present invention.
Figure 2:
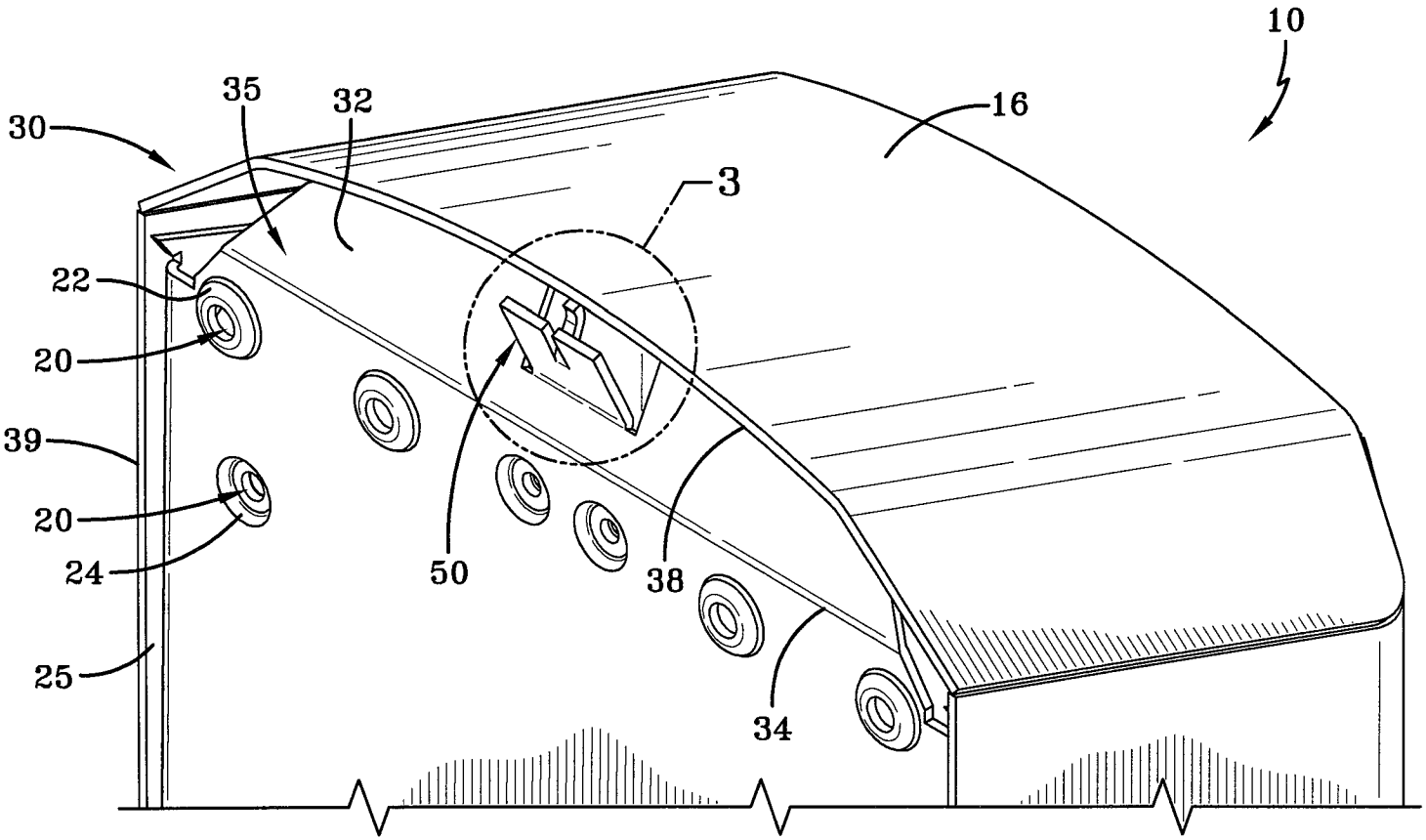
FIG. 2 is an enlarged rear perspective view of a central anti-ligature fixture maintained by the dispenser according to the concepts of the present invention.

Referring now to FIGS. 1 and 2 it can be seen that an anti-ligature dispenser is designated generally by the numeral 10. The dispenser 10 includes a dispenser housing 12 which contains material to be dispensed. In most embodiments, the material to be dispensed is a fluid material such as soap, lotions or sanitizers. In other embodiments, paper products or vending-type products may be dispensed. The material may be dispensed by a hand-actuated lever or by some type of sensor detection. The dispenser housing 12 includes a backplate 14 which in most embodiments is substantially planar. A housing cover 16 is connected to the backplate 14. In some embodiments, the housing cover 16 is sized to fully encapsulate the backplate 14 when the dispenser is in an operational condition. In other words, no edges of the backplate 14 are exposed when the housing cover is closed. Moreover, the cover 16 may be made of a rigid material of appropriate thickness that is difficult to dent or deform, such as stainless steel, other metals, and select polymer materials.

A lower edge 15 of the backplate 14 and a lower internal portion 17 of the cover 16 may form a recess 19 therebetween. In the embodiment shown, a hinge 18 associates the backplate 14 with the cover and is maintained internally within the recess 17. As a result, there is no external access to the hinge when the cover is in a closed position. This configuration prevents a ligature from being inserted between an underside or side of the housing and a mounting surface and becoming attached to any part of the hinge or any structure associated with the hinge. Skilled artisans will appreciate that a hinge is not required and that the cover 16 may be detachable or removable with respect to the backplate 14 in any number of other ways.

Figure 4:
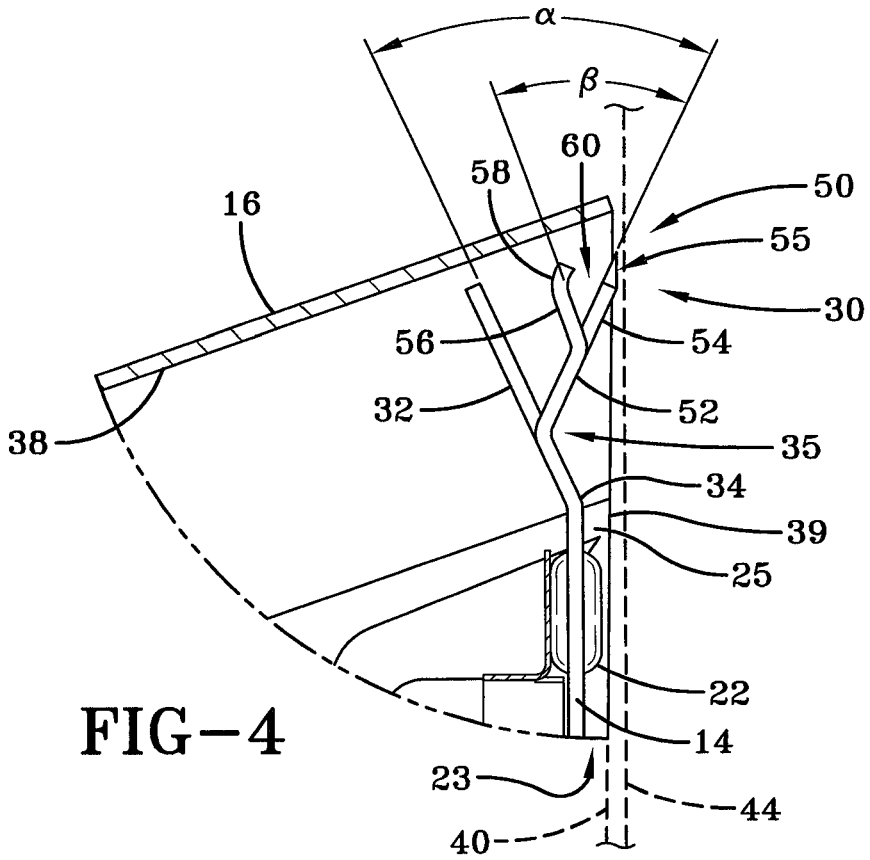
FIG. 4 is a detailed cross-sectional view taken along lines 4-4 of FIG. 1 of the central anti-ligature fixture in relation to a surface upon which the dispenser is mounted according to the concepts of the present invention.

The backplate 14 may include a plurality of mounting holes 20 extending therethrough. The mounting holes may be used to receive fasteners so as to secure the backplate 14 to a mounting surface such as a wall or a countertop, or to secure internal dispenser components. Some of the mounting holes 20 may be surrounded by a raised boss 22 which extends outwardly from the surface of the backplate 14. As will become apparent as the description proceeds and as best seen in FIGS. 2 and 4, the bosses 22 are strategically located on the backplate 14 so that mounting of the backplate 14 to a mounting surface ensures that a dimensionally consistent and uniform space 23 is maintained therebetween. As a result, the backplate 14 is maintained in a substantially parallel and spaced apart relationship with respect to the mounting surface. Moreover, the bosses 22 may accommodate a cover lip 25, which is part of the cover 16 that dimensionally extends beyond the backplate 14 about a same distance that the bosses extend from the backplate 14. Such a configuration allows for the cover, and in particular cover lip 25, to be secured as close as feasibly possible to the mounting surface. Other mounting holes 20 may be associated with a counterbore 24 which may be utilized to receive fasteners which mount internal components of the dispenser to the backplate 14. Use of the counterbores 24 accommodate the fastener heads so that the heads do not interfere with the close fit between a cover edge of the cover 16 and the mounting surface.

An central anti-ligature fixture designated generally by the numeral 30 is provided by the dispenser 10. The fixture 30 may include a flange 32 which angularly extends inwardly from the backplate 14 toward an underside of a top or other side of the housing cover 16. The angular orientation of the flange 32 may be anywhere from 15° to 75° with respect to the backplate 14 at a flange bend 34. As such, the flange 32 extends from the backplate 14 at the flange bend 34. The flange 32 forms a fixture cavity 35 in conjunction with a cover underside 38 or similar interior surface. In other words, the fixture cavity 35 is formed between the cover underside 38, the flange 32 and the flange bend 34.

As best seen in FIG. 4, skilled artisans will appreciate that the housing cover 16 provides a cover edge 39 that forms an imaginary plane 40 that extends between all sides of the housing cover 16. In other words, the imaginary plane 40 extends from the cover edge on one side of the housing cover to the cover edge on an opposite side of the housing cover. In such an embodiment, a top surface of the bosses 22 and the cover edge 39 lie in or are co-planar with the imaginary plane 40. As is evident from the drawings, the backplate 14 is somewhat recessed from the cover edge 39 so as to form the cover lip 25, although the cover edge may be flush with the backplate in some embodiments. In the embodiment shown, the imaginary plane 40 is substantially parallel to the backplate 14, but in other embodiments, the imaginary plane 40 and the backplate 14 may be co-planar with one another. In most embodiments the cover edge 39 abuts a mounting surface 44. However, skilled artisans will appreciate that in some instances gaps may occur between the mounting surface and the cover edge because the mounting surface is non-planar or because of dimensional irregularities in the cover edge or both.

Figure 3:
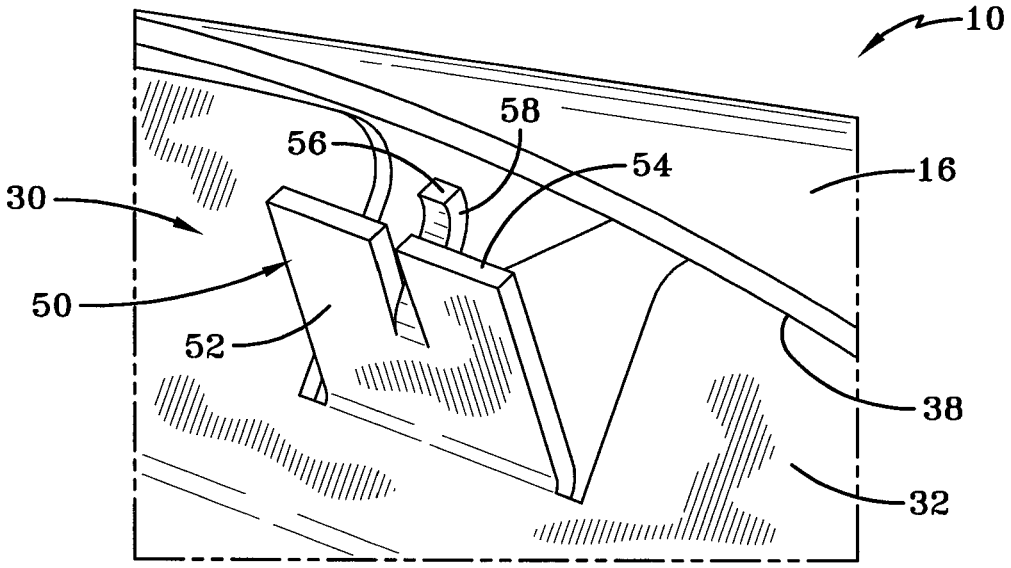
FIG. 3 is a detailed view of a catch, which is part of the central anti-ligature fixture, according to the concepts of the present invention.

Referring now to FIGS. 3 and 4, it can be seen that the dispenser 10 and, in particular the central anti-ligature fixture 30, provides a catch 50. The catch 50 extends from the flange 32 into the fixture cavity 35. The catch 50 may include an arm 52 which extends from the flange 32 at an angle ranging anywhere from between 20° to 80°. In the embodiment shown, the angle is about 50 degrees and is designated by the Greek letter $\alpha$. At the end of the arm 52 is a tip 54 which may extend up to or slightly beyond the imaginary plane 40. As a result, the tip 54 angularly extends from the backplate 14 toward the mounting surface. In one embodiment, a sharp edge 55 may be provided at the tip 54. Angularly extending from the arm 52 may be a finger 56. The finger 56 may angularly extend from the arm at an angle of anywhere between 25° and 65°. In the embodiment shown, the angular orientation of the arm with respect to the finger is about 45° and is designated by the Greek letter $\beta$. In some embodiments, the finger 56 may provide a knuckle 58 which extends the end of the finger 56 toward the tip 54. Together the tip 54 and the finger 56 may define a notch 60.

Although the anti-ligature fixture 30 extends from the backplate 14 and, in particular, the flange 32, skilled artisans will appreciate that the fixture 30 and the components of the catch 50 may extend from the cover underside 38. The only requirement of the positioning of the catch 50 is that the tip 54 and, if provided, the sharp edge 55, be oriented toward the underside 38 of the housing cover and not toward the flange 34. In other words, the tip should be oriented in such a way to engage any ligature that is inserted between the mounting surface and the dispenser. It will also be appreciated that any number of fixtures 30, including the catches 50, may be provided by the dispenser. Indeed, the catches may be strategically disposed about the dispenser's periphery to ensure that the dispenser or any structural component thereof cannot be used as an anchor point.

Figure 5:
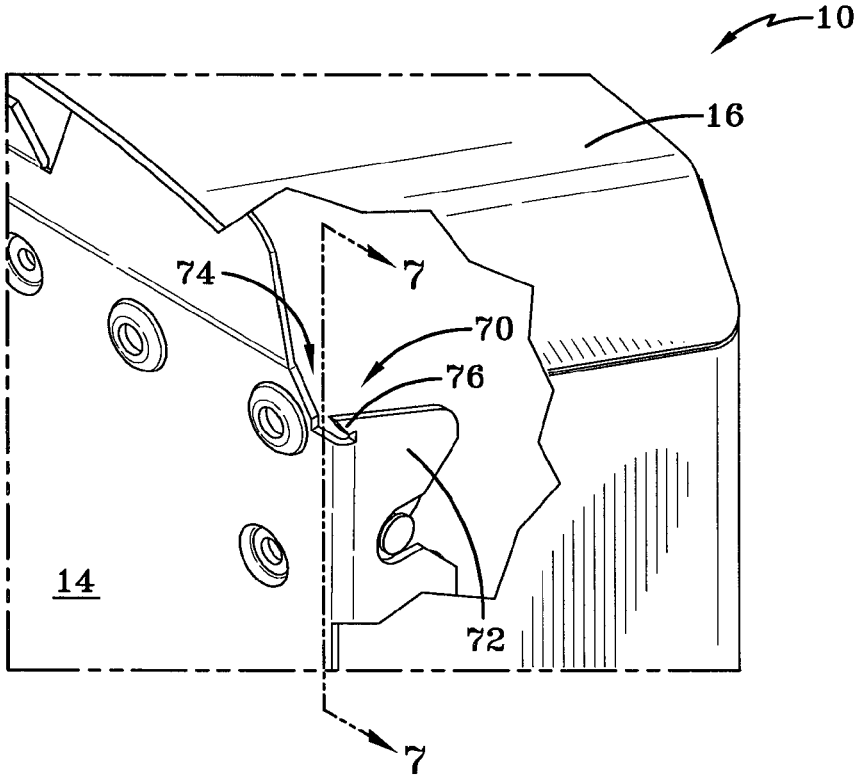
FIG. 5 is a partial rear perspective view of the dispenser with a portion of a housing broken away according to the concepts of the present invention.
Figure 6:
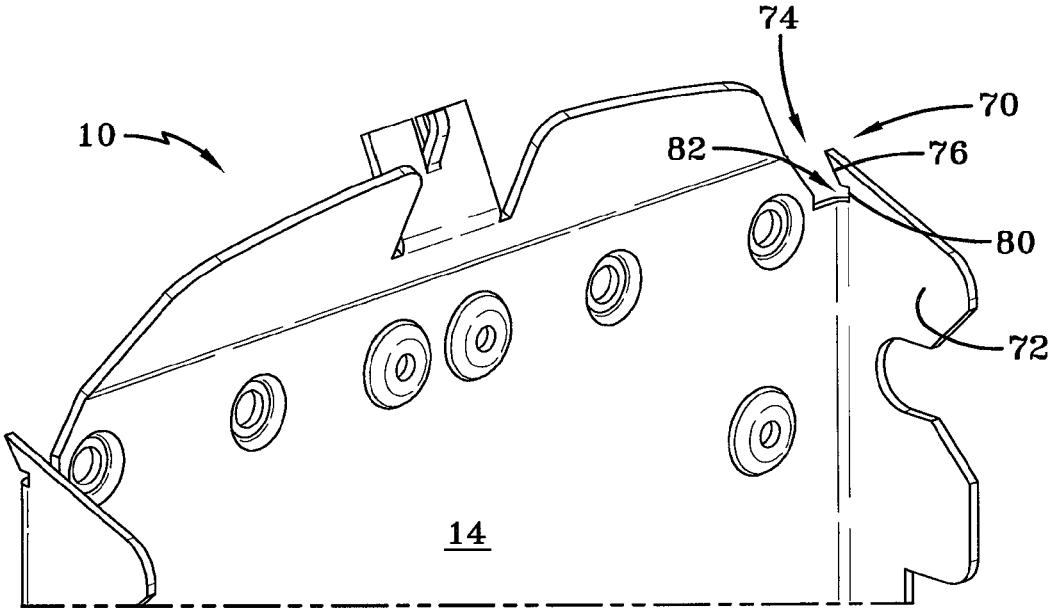
FIG. 6 is a partial front perspective view of a backplate of the dispenser according to the concepts of the present invention.
Figure 7:
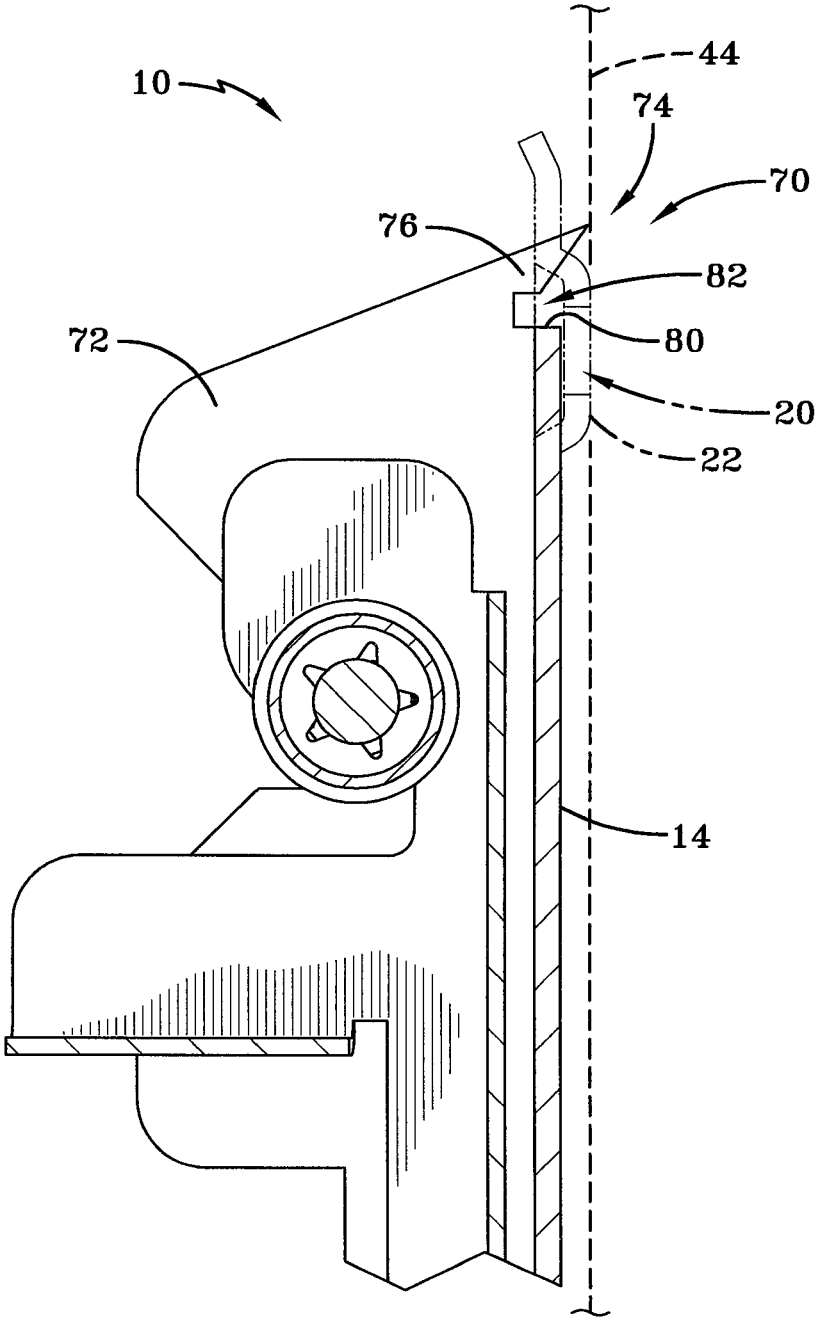
FIG. 7 is a detailed cross-sectional view taken along lines 7-7 of FIG. 5 of a side anti-ligature fixture in relation to the surface upon which the dispenser is mounted according to the concepts of the present invention.

Referring now to FIGS. 1 and 5-7, it can be seen that a side anti-ligature fixture is designated by the numeral 70. The fixture 70 is similar to the fixture 30, except for being positioned at a side or top corner of the dispenser 10. The back plate 14 includes a side bracket 72 that extends substantially at a right angle from the backplate 14. Features of the side bracket 72 are provided to assist in holding the cover 16 when in a closed position. The side bracket 72 also functions to provide structural integrity to the back plate so as to prevent it from being easily deformed. FIGS. 5-7 show the fixture 70 associated with one of the top corners, but it will be appreciated that such a feature can be provided in either or both sides, the other top corner and, in some embodiments, also in the bottom corners if deemed appropriate. In any event, the fixture 70 includes a catch 74. The catch 74 may provide a tip 76 that angularly extends from the side bracket 72. In some embodiments the tip 76 may be oriented so as to be perpendicular to the mounting surface 44. In other embodiments, the tip 76 may be oriented at an angle anywhere between 0 to 90° and in some embodiments may be oriented at an angle of between 20 to 70°. In the embodiment shown, the tip is oriented at an angle of 35°±5°. The tip 76 may be capable of cutting ligatures of most any type and, in particular, towels, bed sheets and the like. An arm 80 perpendicularly extends from an edge of the backplate 14 so as to form a notch 82. The notch 82 allows the tip 76 to be slightly deflected when a ligature engages the catch 70. As a result, the bending of the tip allows for the material to be further shredded or cut as more force is applied to the catch. The tip may be modified in any number of ways to facilitate the cutting or tearing of a ligature. For example, in some embodiments the tip may be provided with a sharp edge. In other embodiments the tip may be shaped to collect and direct the ligature to a feature adapted to cut or tear the ligature.

In operation, the dispenser 10 is mounted the mounting surface 44. When properly installed, it will be appreciated that the tip 54 and/or the sharp edge 55 of the central anti-ligature fixture is positioned to be in touching contact or in very close proximity to the mounting surface 44. The tip 54 may extend slightly beyond the imaginary plane 40 so as to fit or be oriented in any gap that may form between the cover edge 39 and the mounting surface 44.

Accordingly, in the event someone attempts to insert a ligature between the dispenser 10 and the mounting surface 44, the ligature will come in contact with the catch 50 and in particular components thereof. Specifically, the ligature engages the tip 54 and/or the sharp edge 55 and is torn or shredded such that the ligature is ripped and ineffective in becoming secured around the dispenser. Moreover, the notch 60 may collect and receive any ligature material such that a large amount of the material is precluded from further entering the gap between the dispenser and the mounting surface. The notch 60 may also serve to cut or shred the ligature. The notch forces any added material to further come in contact with the tip 54. Additionally, the provision of the knuckle 58 causes the material to remain within the notch 60 so that it does not migrate or progress to any other area under the cover underside 38. As a result, any appreciable weight that is applied to the inserted ligature will engage the catch and, in particular, the tip 54, and the dispenser becomes ineffective for serving as an anchor point.

In a similar manner, the tip 76 of the side anti-ligature fixture is positioned to be in touching contact or in very close proximity to the mounting surface 44. The tip 76 may extend slightly beyond the imaginary plane 40 so as to fit or be oriented in any gap that may form between the cover edge 39 and the mounting surface 44.

As with the central anti-ligature fixture, the side anti-ligature fixture will engage any a ligature attempted to be inserted into the gap between the housing and the mounting surface. Such a ligature will come in contact with the catch 74 and, in particular, components thereof. The tip 76 and associated features will tear or shred any such ligature so as to render it ineffective in becoming secured around the dispenser. The tip 76 may be somewhat flexible or deflectable in view of the notch 82 such that repeated pulling of the ligature will move the different areas of the ligature into contact with the tip or related features and speed tearing of the ligature. As a result, any appreciable weight that is applied to the inserted ligature will engage the catch and, as such, the dispenser becomes ineffective for serving as an anchor point.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A dispenser mountable to a surface, the dispenser comprising:

a backplate adapted to be mounted to the surface;

a cover enclosing said backplate when in a closed condition; and at least one anti-ligature fixture associated with either said backplate or an underside of said cover, wherein said at least one anti-ligature fixture is positioned within an enclosure of said cover to cut any ligature positioned between the dispenser and the surface as an anchor point.

2. The dispenser according to claim 1 further comprising:

a flange extending inwardly from said backplate toward said underside of said cover such that a fixture cavity is formed between said flange and said underside, said anti-ligature fixture extending into said fixture cavity.

3. The dispenser according to claim 2, wherein said anti-ligature fixture comprises a tip that extends from said flange into said cavity to intersect with an imaginary plane of said cover.

4. The dispenser according to claim 3, wherein said tip has a sharp edge.

5. The dispenser according to claim 3, wherein said anti-ligature fixture comprises:

an arm extending from said flange, wherein said tip extends from said arm.

6. The dispenser according to claim 5, wherein said anti-ligature fixture further comprises:

a finger extending from said arm such that said finger and said tip define a notch.

7. The dispenser according to claim 3 further comprising:

a lower edge of said backplate;

a lower internal portion of said cover, wherein said lower edge and said lower internal portion form a recess therebetween; and a hinge connecting said backplate to said cover wherein said hinge is maintained within said recess.

8. The dispenser according to claim 3 further comprising:

a plurality of bosses extending from said backplate toward the surface a predetermined distance;

said cover having a cover lip that extends beyond said backplate said predetermined distance comparable to said plurality of bosses.

9. The dispenser according to claim 8, wherein said tip is deflectable.

10. The dispenser according to claim 1, further comprising:

a tip angularly extending from said backplate toward the surface.

11. The dispenser according to claim 1, wherein said backplate has a side bracket extending in a direction away from the surface, said side bracket having a tip extending therefrom toward the surface.

12. The dispenser according to claim 1, comprising:

a flange extending inwardly from said backplate;

a side bracket extending inwardly from said backplate;

said at least one anti-ligature fixture comprising at least one of:

a central anti-ligature fixture extending from said flange toward the surface; and a side anti-ligature fixture extending from said side bracket toward the surface, each said anti-ligature fixture having a tip positioned to cut any ligature disposed between the fixture and the surface.

13. The dispenser according to claim 1, wherein said cover is smooth and downwardly sloping.

14. An anti-ligature dispenser mountable to a surface comprising:

a backplate adapted to be mounted to the surface;

a housing cover having an underside, said housing cover hingedly connected to said backplate, said housing cover having a cover edge substantially surrounding and enclosing said backplate so as to abut the surface as closely as possible; and at least one fixture extending from either said backplate or said housing cover underside within said housing cover and having a cutting edge so that any ligature disposed between the surface and said housing cover is ripped and rendered ineffective as an anchor point by said at least one fixture.

15. The dispenser according to claim 14, further comprising:

a flange extending inwardly from said backplate toward said underside, said fixture extending from said flange.

16. The dispenser according to claim 15, wherein said flange and said underside form a recess in which said at least one fixture is received.

17. The dispenser according to claim 16, said fixture comprising:

an arm angularly extending from said flange; and said housing cover edge forming a plane substantially parallel with said backplate, said arm extending at least to said plane.

18. The dispenser according to claim 17 further comprising:

a finger angularly extending from said arm;

a tip extending from said arm in the same general direction as said arm, said finger and said tip forming a notch to receive any ligature disposed between said housing cover edge and the surface.

19. The dispenser according to claim 18 further comprising:

a knuckle extending from said finger toward said tip to facilitate retention of the ligature in said notch, said tip having a sharpened edge to cut or tear the ligature.

20. The dispenser according to claim 14, said fixture comprising:

a side bracket extending inwardly from said backplate, said side bracket having a tip extending therefrom toward the surface.

21. The dispenser according to claim 14, wherein said cover is smooth and downwardly sloping.

* * * * *